US009027500B2

(12) United States Patent
Williams et al.

(10) Patent No.: US 9,027,500 B2
(45) Date of Patent: May 12, 2015

(54) FOLDING BIMINI

(71) Applicant: Xtreme Marine Corporation, Maryville, TN (US)

(72) Inventors: Anthony Duane Williams, Maryville, TN (US); Michael Edward Howard, Loudon, TN (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 14/187,687

(22) Filed: Feb. 24, 2014

(65) Prior Publication Data

US 2014/0261142 A1 Sep. 18, 2014

Related U.S. Application Data

(60) Provisional application No. 61/878,335, filed on Sep. 16, 2013, provisional application No. 61/779,415, filed on Mar. 13, 2013.

(51) Int. Cl.
*B63B 17/02* (2006.01)

(52) U.S. Cl.
CPC ..... *B63B 17/02* (2013.01)

(58) Field of Classification Search
CPC .. B63B 1/00; B63B 2201/00; B63B 2203/00; B63B 17/02; B63B 2017/026
See application file for complete search history.

(56) References Cited

U.S. PATENT DOCUMENTS

| | | | | |
|---|---|---|---|---|
| 4,951,594 | A * | 8/1990 | Feikema | 114/361 |
| 6,945,188 | B2 | 9/2005 | Eck et al. | |
| 2006/0090685 | A1 * | 5/2006 | Fishburn | 114/361 |
| 2006/0124045 | A1 * | 6/2006 | Tucker et al. | 114/361 |

* cited by examiner

*Primary Examiner* — Edwin Swinehart
(74) *Attorney, Agent, or Firm* — Luedeka Neely Group, P.C.

(57) ABSTRACT

A foldable bimini for a boat that is rigid and bi-directionally stable in an erected orientation, the bimini including a rigid arch-shaped frame fixedly mountable onto the boat having a disengageable bimini mount; and a foldable bimini support, including a rigid arch member pivotally mounted to the rigid arch shaped frame and at least one rigid leg pivotally mounted to the rigid arch member and releasably connectable to the frame.

5 Claims, 6 Drawing Sheets

FOLDING BIMINI

CROSS-REFERENCE TO RELATED APPLICATIONS

This application claims priority to U.S. Provisional Application No. 61/878,335, filed Sep. 16, 2013, and entitled FOLDING BIMINI, and U.S. Provisional Application No. 61/779,415, filed Mar. 13, 2013, and entitled FOLDING CARGO BIMINI TOP, both incorporated by reference herein in their entirety.

FIELD

This disclosure relates to the field of bimini covers for boats. More particularly, the disclosure relates to a folding bimini having a rigid frame component and a folding bimini support component having improved rigidity and bi-directional stability.

BACKGROUND

Improvement is desired in the provision of sun covers for boats. In particular, what is desired is a sun cover structure that is substantially rigid and stable when erected, but, which can be folded when not in use.

Conventional folding sun covers, such as bimini tops, lack sufficient rigidity and bi-directional stability when erected. For example, to maintain the top in an elevated or erected orientation, straps or the like are utilized to tension the cover and fail to provide a sun cover structure that is sufficient rigidity and bi-directionally stable.

The disclosure advantageously provides a tower structure for a boat that incorporates a foldable component for supporting a sun cover, with the resulting structure being rigid and bi-directionally stable.

SUMMARY

The disclosure relates to a foldable bimini that is rigid and bi-directionally stable in an erected orientation on a boat.

In one aspect, the foldable bimini includes a rigid arch-shaped frame fixedly mountable onto the boat and having a disengageable bimini mount; and a foldable bimini support, including a rigid arch member pivotally mounted to the rigid arch shaped frame and at least one rigid leg pivotally mounted to the rigid arch member and releasably connectable to the frame.

The bimini support may be positioned in an erected orientation by pivoting the rigid arch member away from the rigid arch-shaped frame and then pivoting the leg to engage a lower end of the leg with the disengageable bimini mount of the rigid arch-shaped frame to connect the lower end of the leg to the rigid arch-shaped frame with the resulting structure of the bimini support as connected to the rigid arch shaped frame being rigid and bi-directionally stable so as to avoid relative movement of the rigid arch member relative to the rigid arch-shaped frame.

In another aspect, the foldable bimini includes a rigid arch-shaped frame fixedly mountable onto the boat, the rigid arch-shaped frame having a pair of disengageable bimini mounts located on opposite sides thereof; and a foldable bimini support.

The foldable bimini support includes a first rigid arch member pivotally mounted to the rigid arch shaped frame, a second rigid arch member pivotally connected to the first rigid arch member, and a pair of rigid legs pivotally mounted to opposite sides of the first arch member and each being releasably connectable to one of the disengageable bimini mounts of the rigid arch-shaped frame.

The bimini support may be positioned in an erected orientation by pivoting the first rigid arch member away from the rigid arch-shaped frame and pivoting each of the rigid legs to engage a lower end of each of the legs with one of the disengageable bimini mounts of the rigid arch-shaped frame to connect the lower ends of the legs to the rigid arch-shaped frame. The resulting structure of the bimini support as connected to the rigid arch shaped frame being rigid and bi-directionally stable so as to avoid relative movement of the first rigid arch member relative to the rigid arch-shaped frame.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The disclosure relates to a tower structure for a boat that incorporates a foldable component for supporting a sun cover, with the resulting structure being rigid and bi-directionally stable.

With reference to the drawings, the disclosure relates to a folding bimini 10 having a rigid frame 12 mountable onto a boat B, and a folding bimini support 14 having improved rigidity and bi-directional stability that cooperates with the frame 12 and the boat B. A flexible sun cover 16 cooperates with the frame 12 and the folding bimini support 14.

Figure 1:
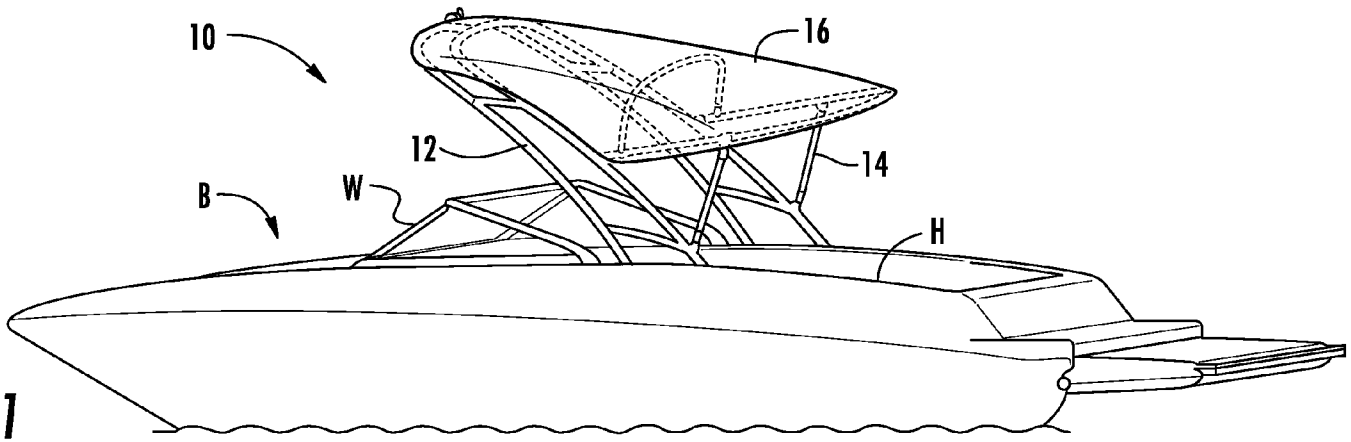
FIG. 1 shows a folding bimini cover according to the disclosure mounted onto a boat and unfolded to provide a covering structure.
Figure 2:
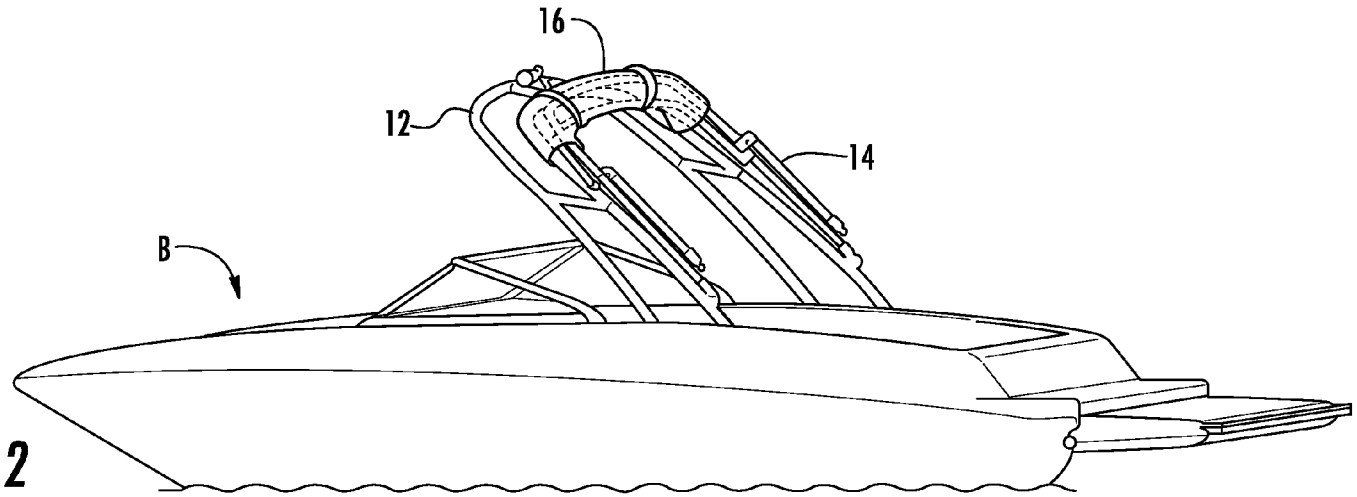
FIG. 2 shows the folding bimini cover of FIG. 1 mounted to the boat and oriented in a folded position.
Figure 3:
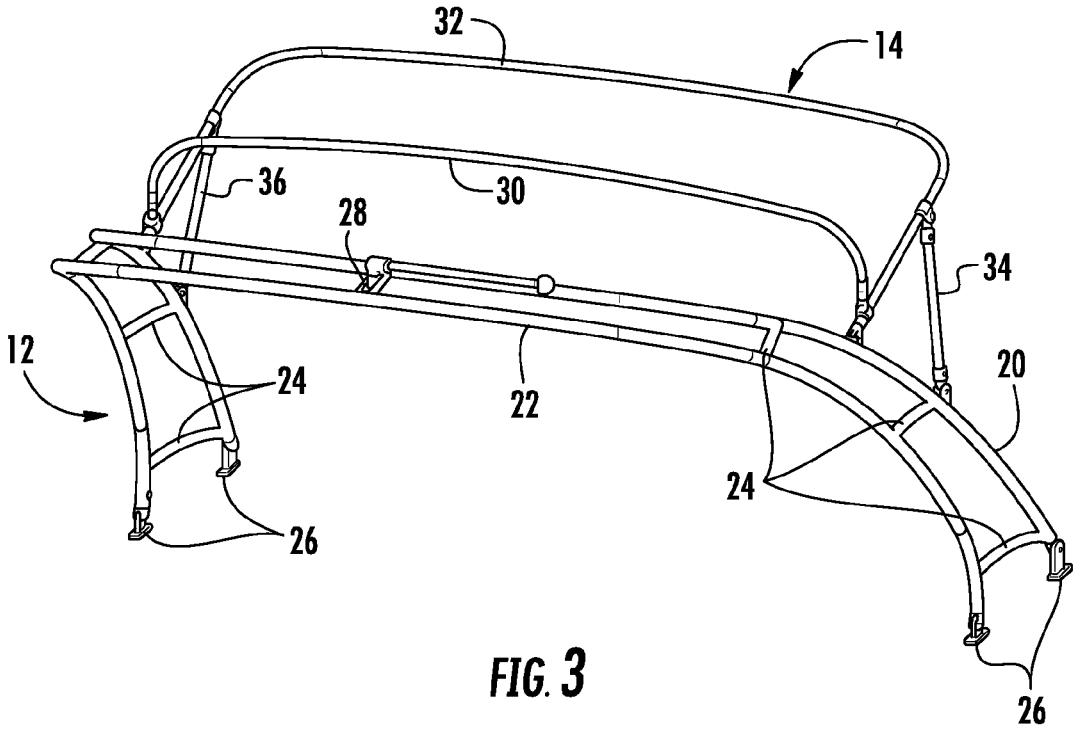
FIGS. 3 and 4 show a rigid frame component and a folding bimini support component of the bimini cover of FIG. 1, with the folding bimini support component in an unfolded orientation.
Figure 4:
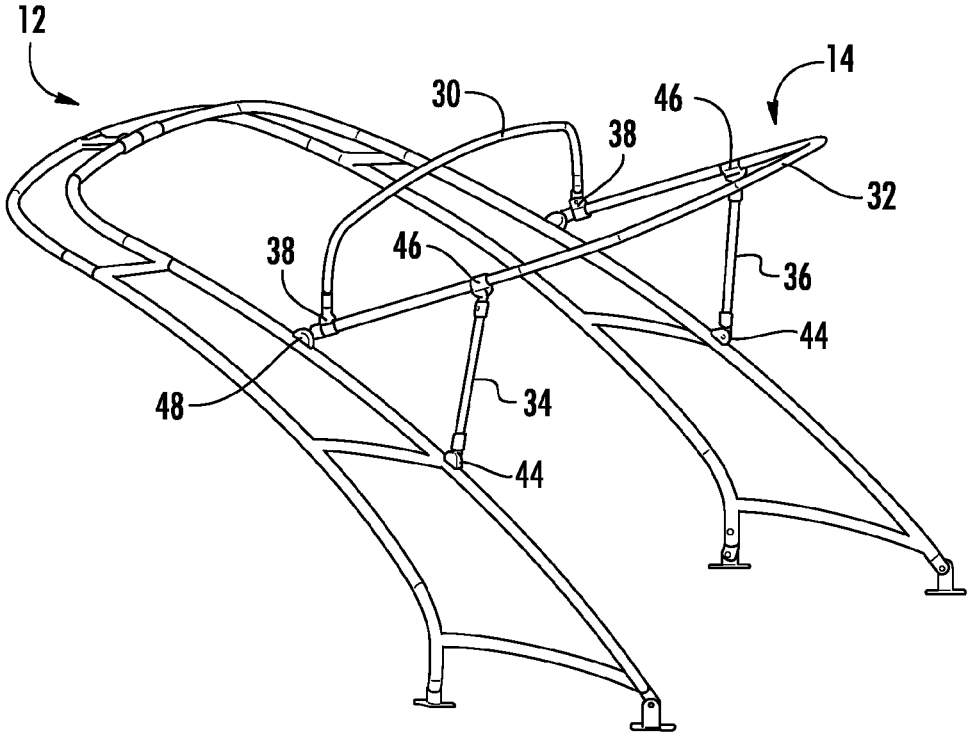

As seen in FIG. 1, the folding bimini 10 may be erected by unfolding the support 14 and spanning the cover 16 over the frame 12 and the erected support 14. The bimini 10, if desired, may be returned to an orientation not having the sun cover, as shown in FIG. 2, by folding the support 14 and wrapping the cover 16 around portions of the support 14.

The rigid frame 12 may be of welded aluminum tubing construction and is configured in the shape of an arch mountable to a hull H of the boat B aft of a windshield W of the boat B adjacent a cockpit area of the boat B. The frame 12 extends in a forward or bow direction, rising along its length. The frame 12 includes leg members 20 and 22 connected by cross-pieces 24. Mounts 26 are located at the lower ends of the leg members 20 and 22 for mounting the frame 12 to the hull H. A folding navigational light 28 may be located on the frame 12, with the wiring routed within the frame 12.

Figure 5:
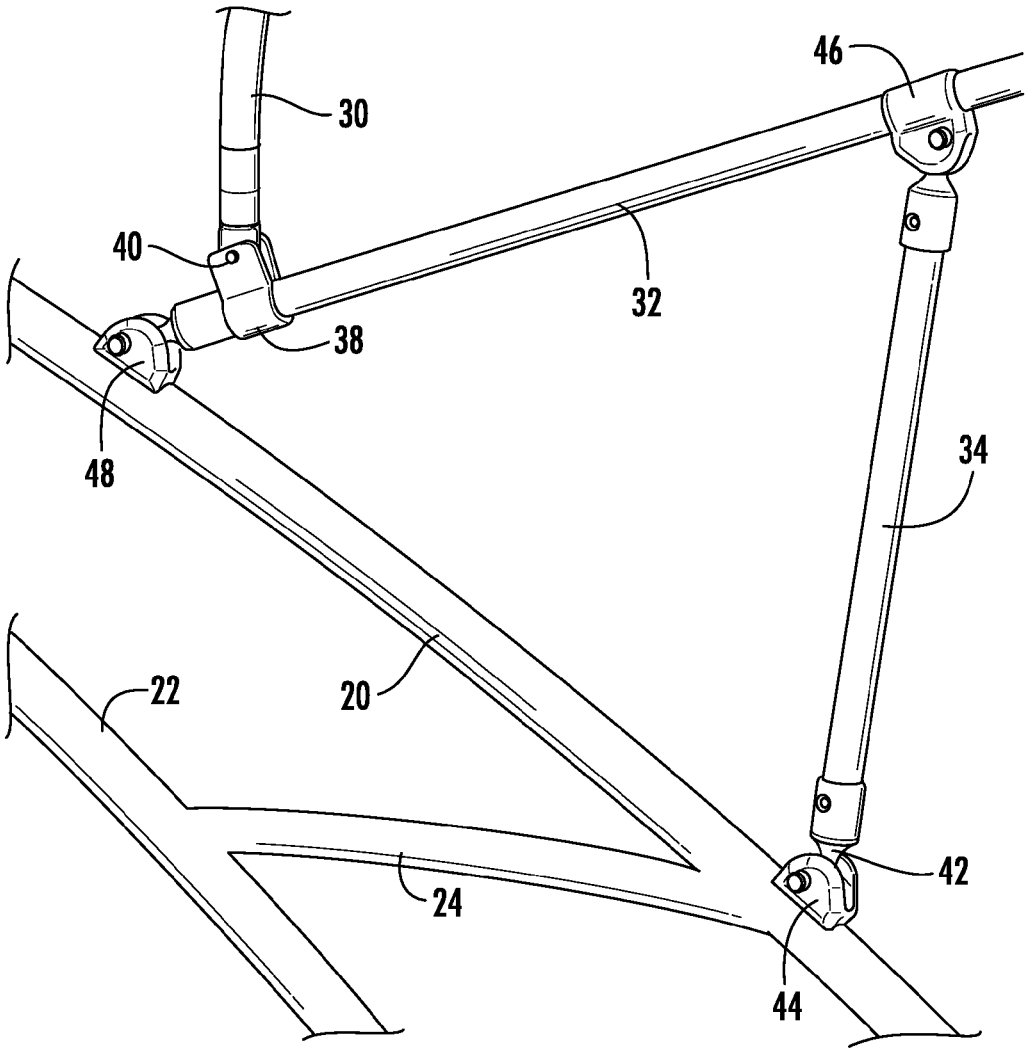
FIG. 5 is an enlarged view of a portion of FIG. 4.
Figure 6:
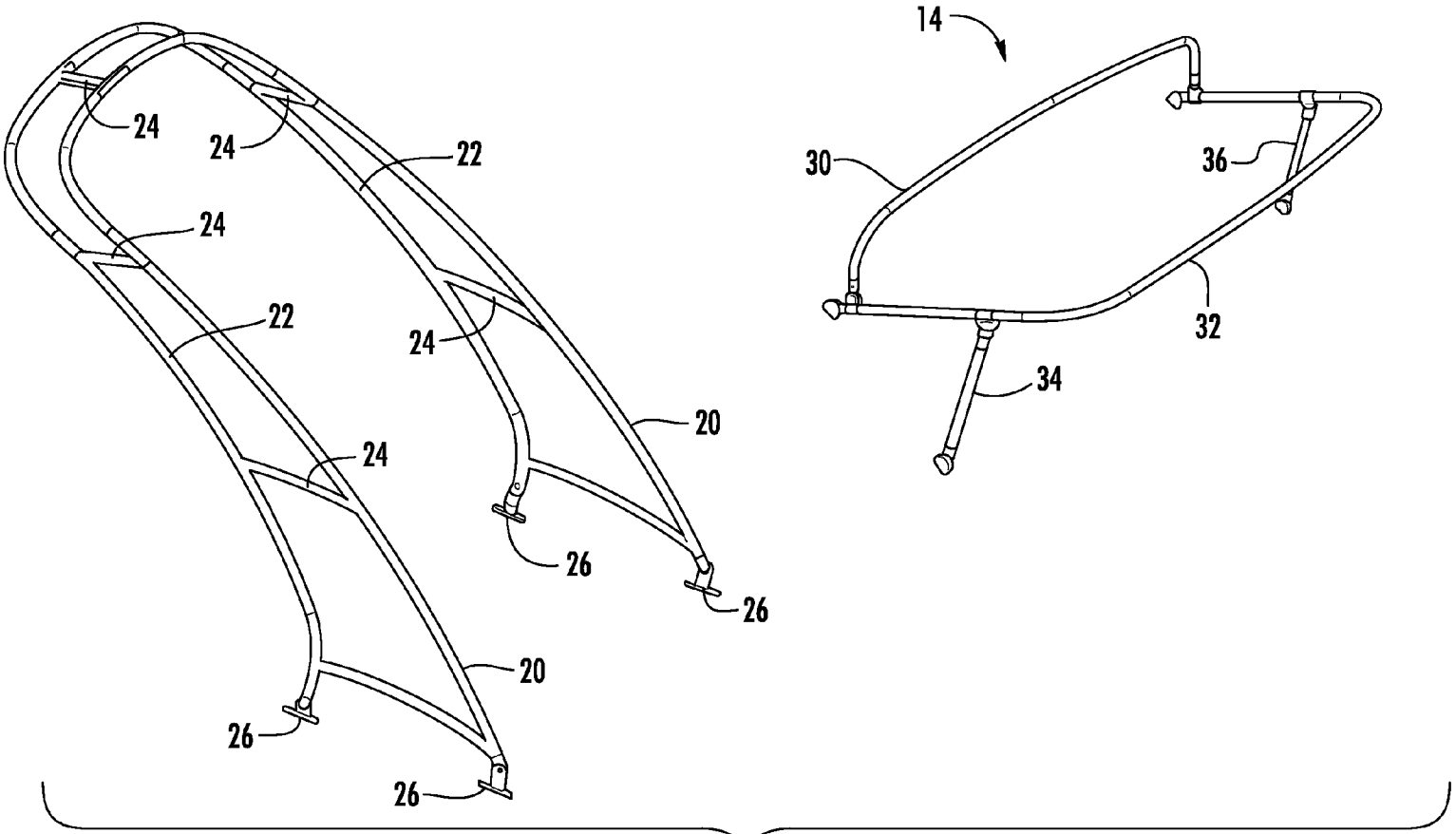
FIG. 6 is an exploded view of FIG. 4.
Figure 7:
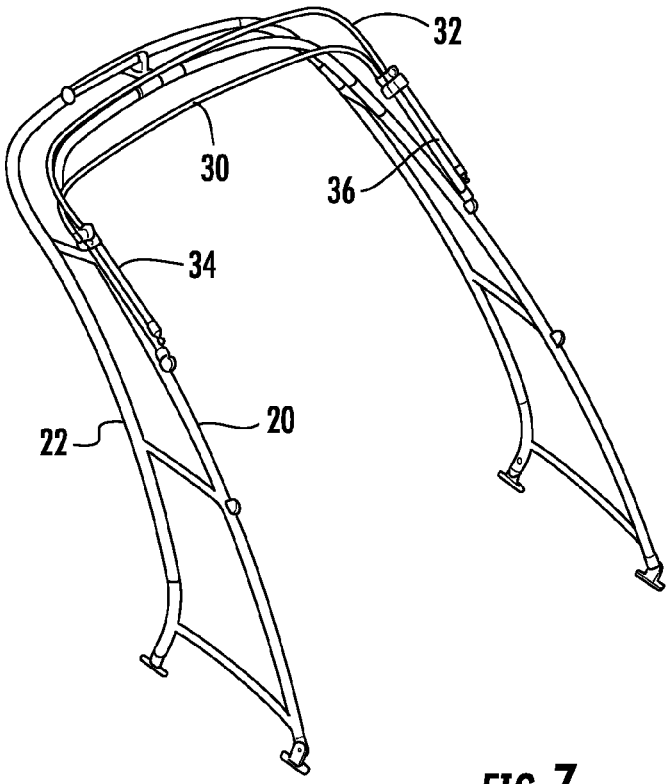
FIGS. 7 and 8 show the rigid frame component and the folding bimini support component of the bimini cover of FIG. 1, with the folding bimini support component in an folded orientation.
Figure 8:
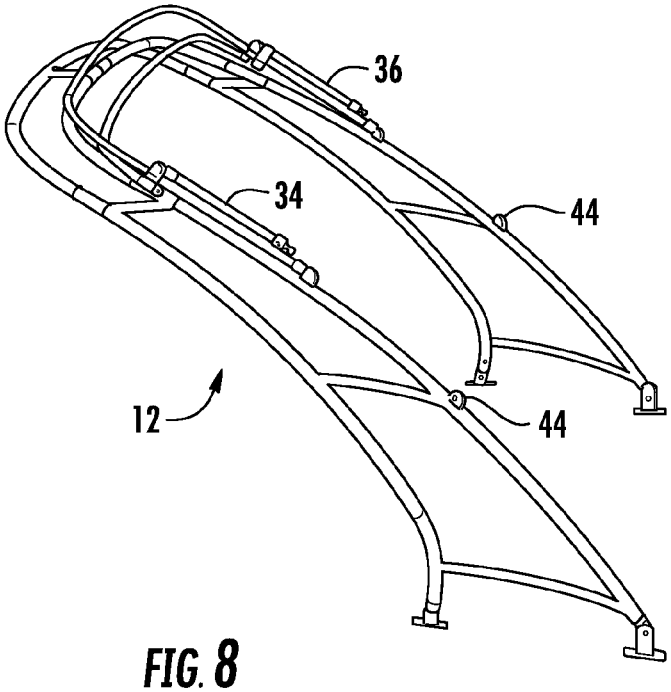
Figure 9:
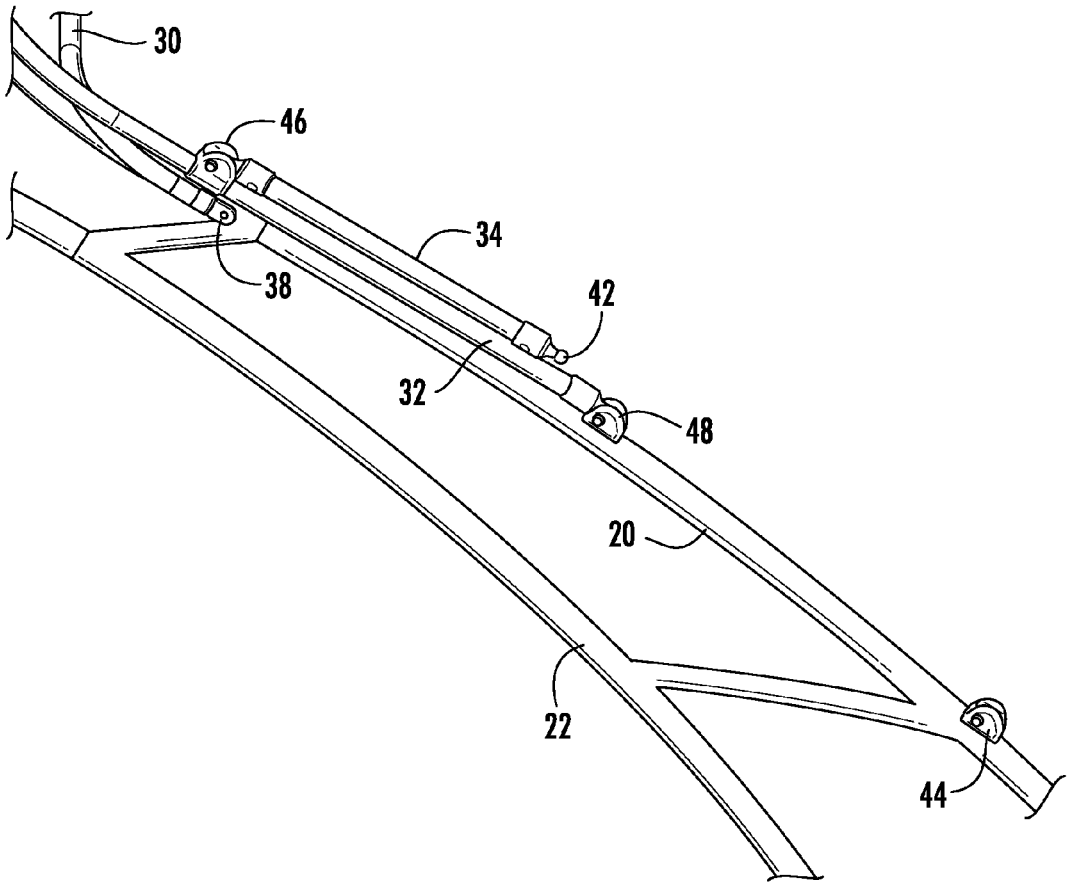
FIG. 9 is an enlarged view of a portion of FIG. 8.

The folding bimini support 14 includes a pair of rigid arch members 30 and 32 and a pair of rigid legs 34 and 36. The arch members 30 and 32 and the legs 34 and 36 may be made of aluminum tubing. The arch member 30 is pivotally mounted to the arch member 32 as by mounts 38. As seen in FIG. 5, the mounts 38 may be U-shaped members that fit over the leg 32 and receive ends of the arch member 30. A pin or other fastener 40 may be passed through the mount 38 and the end of the arch member 30 to pivotally connect the arch member 30 to the arch member 32.

The lower ends of the legs 34 and 36 are releasably connectable to the frame 12 as by a releasable ball and socket joint. For example, the lower ends of the legs 34 and 36 may each be fitted with an end cap having a distal ball 42, and disengageable socket mounts 44 may be provided on the leg 20 for receiving the balls 42 when the bimini support 14 is in the erected or unfolded orientation. The socket mounts 44 serve to retain the balls 42 to connect the lower ends of the legs 34 and 36 to the frame 12. However, when it is desired to fold the bimini support 14, the balls 42 may be manually disengaged from the sockets 44 to release the lower ends of the legs 34 and 36 from the frame 12.

The upper ends of the legs 34 and 36 are pivotally mounted to the leg 32 as by mounts 46. The mounts 46 may be configured in the manner of the socket mounts 44, with the upper ends of the legs 34 and 36 including an end cap having a distal ball.

The lower ends of the arch member 32 are pivotally mounted to the frame 12 as by mounts 48. The mounts 48 may also be configured in the manner of the socket mounts 44, with the ends of the arch member 32 including an end cap having a distal ball.

The flexible sun cover 16 is provided as a flexible fabric material dimensioned to conform to and span between the frame 12 and the bimini support 14 when the support 14 is in the erected orientation. When the support 14 is in the folded orientation, the cover 16 may be rolled around the arch members 30 and 32. The cover 16 is generally of a bimini or open-front style and may be secured to the frame 12 and the support 14 as by ties or snap fasteners or the like so that the cover 16 fits tightly and securely over the frame 12 and the support 14 when the support 14 is erected.

The bimini support 14 may be positioned in an erected orientation, such as shown in FIG. 1, by pivoting the arch member 32 away from the frame 12 and then pivoting the legs 34 and 36 so that the balls 42 on the ends thereof may be engaged into the socket mounts 44 to connect the lower ends of the legs 34 and 36 to the frame 12. This serves to tension the cover 16 and provide the rigid and bi-directionally stable bimini 10. The tension of the cover 16 may be further adjusted by pivoting the arch member 30 relative to the cover 16 to adjust the pressure applied by the arch member 30 to the cover 16. As will be appreciated, the use of the legs 34 and 36 in combination with the releasable connection of the lower ends of the legs 34 and 36 to the frame provides a structure that is rigid and bi-directionally stable. That is, this structure serves to inhibit any relative movement of the arch member 32 relative to the frame during use of the bimini 10 in the erected orientation.

The bimini support 14 may be positioned in a folded orientation, such as shown in FIG. 2, by disengaging balls 42 of the lower ends of the legs 34 and 36 from the mounts 44 to disengage the legs 36 and 36 from the frame 12, and then pivoting the arch member 32 and the arch member 30 toward from the frame 12. The cover 16 may be wrapped around the arch members 30 and 32 to provide the folded orientation. If desired, a strap or tie applied to hold the arch members 30 and 32 against the frame 12.

As will be appreciated, the combination of the rigid frame 12, with the foldable support 14 having the rigid arch members 30 and 32, with the legs 34 and 36 being provided by rigid members such as aluminum tubing, enables the erected support 14 to be a rigid structure that is bi-directionally stable and avoids relative movement of the arch member 32 relative to the frame during use of the bimini 10 in the erected orientation. In certain embodiments, the rigidity and stability allow the folding bimini structure 10 to be used to hold cargo such as tubes, skis, wakeboard, and other equipment on an upper surface of the sun cover 16 when the bimini support 14 is in an erected orientation, with the arch member 30 providing central support for the cargo. The cargo may be held in position on the upper surface of the sun cover 16 using straps, bungee cords, or other securing mechanisms.

Thus, the folding bimini structure 10 according to the disclosure offers advantages in terms of a rigid structure for a sun cover, but that can be folded if desired.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A foldable bimini that is rigid and bi-directionally stable in an erected orientation on a boat, the bimini comprising:

a rigid arch-shaped frame comprising a first leg mountable to a first side of the boat, a second leg mountable to a second side of the boat, a cross-piece connected to upper ends of the first and second legs for spanning across the boat, and a disengageable bimini mount; and a foldable bimini support, comprising a first rigid arch member pivotally mounted to the rigid arch shaped frame and at least one rigid leg pivotally mounted to the first arch member and releasably connectable to the disengageable bimini mount of the rigid arch-shaped frame, wherein the bimini support may be positioned in an erected orientation by pivoting the first rigid arch member away from the rigid arch-shaped frame and pivoting the leg to engage a lower end of the leg with the disengageable bimini mount of the rigid arch-shaped frame to connect the lower end of the leg to the rigid arch-shaped frame, with the resulting structure of the bimini support as connected to the rigid arch shaped frame being rigid and bi-directionally stable so as to avoid relative movement of the first rigid arch member relative to the rigid arch-shaped frame.

2. The foldable bimini of claim 1, wherein the foldable bimini support further comprises a second rigid arch member pivotally connected to the first rigid arch member.

3. The foldable bimini of claim 1, further including a flexible sun cover, the sun cover comprising a flexible material dimensioned to conform to and span between the rigid arch-shaped frame and the foldable bimini support when the foldable bimini support is in the erected orientation, and the cover may be rolled around the first rigid arch member for storage when the foldable bimini support is in the folded orientation.

4. A foldable bimini that is rigid and bi-directionally stable in an erected orientation on a boat, the bimini comprising:

a rigid arch-shaped frame comprising a first leg mountable to a first side of the boat a second leg mountable to a second side of the boat a cross-piece connected to upper ends of the first and second legs for spanning across the boat, a first disengageable bimini mount located on the first leg, and a second disengageable bimini mount located on the second leg; and a foldable bimini support, comprising a first rigid arch member pivotally mounted to the rigid arch shaped frame, a second rigid arch member pivotally connected to the first rigid arch member, and a pair of rigid legs pivotally mounted to opposite sides of the first arch member and each being releasably connectable to one of the disengageable bimini mounts of the rigid arch-shaped frame, wherein the bimini support may be positioned in an erected orientation by pivoting the first rigid arch member away from the rigid arch-shaped frame and pivoting each of the rigid legs to engage a lower end of each of the legs with one of the disengageable bimini mounts of the rigid arch-shaped frame to connect the lower ends of the legs to the rigid arch-shaped frame, with the resulting structure of the bimini support as connected to the rigid arch shaped frame being rigid and bi-directionally stable so as to avoid relative movement of the first rigid arch member relative to the rigid arch-shaped frame.

5. The foldable bimini of claim 4, further including a flexible sun cover, comprising a flexible material dimensioned to conform to and span between the rigid arch-shaped frame and the foldable bimini support when the foldable bimini support is in the erected orientation, and the cover may be rolled around the first and second rigid arch members for storage when the foldable bimini support is in the folded orientation.

* * * * *